US011225070B2

(12) United States Patent
Leigh et al.

(10) Patent No.: US 11,225,070 B2
(45) Date of Patent: Jan. 18, 2022

(54) FLUIDIC DIES WITH BEVELED EDGES UNDERNEATH ELECTRICAL LEADS

(71) Applicant: Hewlett-Packard Development Company, L.P., Spring, TX (US)

(72) Inventors: Stan E. Leigh, Corvallis, OR (US); Kellie Susanne Jensen, Corvallis, OR (US); Terry McMahon, Corvallis, OR (US); Donald W. Schulte, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/760,923

(22) PCT Filed: Jan. 23, 2018

(86) PCT No.: PCT/US2018/014788
§ 371 (c)(1),
(2) Date: May 1, 2020

(87) PCT Pub. No.: WO2019/147217
PCT Pub. Date: Aug. 1, 2019

(65) Prior Publication Data

US 2021/0170746 A1 Jun. 10, 2021

(51) Int. Cl.

| | |
|---|---|
| ***B41J 2/175*** | (2006.01) |
| ***B41J 2/14*** | (2006.01) |
| ***B41J 2/015*** | (2006.01) |
| ***B41J 2/135*** | (2006.01) |

(52) U.S. Cl.
CPC ..... *B41J 2/14* (2013.01); *B41J 2/015* (2013.01); *B41J 2/135* (2013.01); *B41J 2/17523* (2013.01); *B41J 2/17526* (2013.01)

(58) Field of Classification Search
CPC ..... B41J 2/14072; B41J 2/16; B41J 2/1603; B41J 2/1606; B41J 2/1623; B41J 2/1626; B41J 2/1628; B41J 2/1631; B41J 2/1632; B41J 2/17503; B41J 2/17523;
(Continued)

(56) References Cited

U.S. PATENT DOCUMENTS 5,519,421 A * 5/1996 Barr ..... B41J 2/14024 347/47
5,736,998 A 4/1998 Caren et al.
5,953,034 A 9/1999 Salomon et al.
(Continued)

FOREIGN PATENT DOCUMENTS

EP 1182037 A1 2/2002
EP 1415812 B1 5/2004

*Primary Examiner* — Anh T Vo
(74) *Attorney, Agent, or Firm* — Fabian VanCott

(57) ABSTRACT

In one example in accordance with the present disclosure, a fluidic die is described. The fluidic die includes a surface on which a number of nozzles are formed. An electrical interface on the fluidic die establishes an electrical connection between the fluidic die and a fluidic die controller. The electrical interface includes 1) a bond pad disposed within a bond pad region of the surface and 2) an electrical lead coupled to the bend pad to establish an electrical connection between the fluidic die and the fluidic die controller. The fluidic die also includes a beveled edge along an edge of the surface underneath the electrical lead.

20 Claims, 7 Drawing Sheets

(58) Field of Classification Search
CPC ..... B41J 2/17526; B41J 2/17546; Y10T 29/49052; Y10T 29/49083; Y10T 29/49401
See application file for complete search history.

(56) References Cited

U.S. PATENT DOCUMENTS

| | | | | |
|---|---|---|---|---|
| 6,188,414 | B1 | 2/2001 | Wong et al. | |
| 6,331,049 | B1 | 12/2001 | Leban | |
| 6,402,299 | B1 * | 6/2002 | DeMeerleer | B41J 2/14016 347/50 |
| 6,439,698 | B1 * | 8/2002 | Patil | B41J 2/14072 347/56 |
| 6,962,406 | B2 | 11/2005 | Kawamura et al. | |
| 7,926,916 | B2 * | 4/2011 | Schmidt | B41J 2/1752 347/63 |
| 2002/0122097 | A1 | 9/2002 | Beerling et al. | |
| 2005/0248629 | A1 | 11/2005 | Bowling et al. | |
| 2006/0176338 | A1 * | 8/2006 | Deguchi | B41J 2/1629 347/43 |
| 2007/0279453 | A1 | 12/2007 | De Kegelaer | |
| 2014/0340452 | A1 * | 11/2014 | Kunnavakkam | B41J 2/14129 347/62 |

* cited by examiner

FLUIDIC DIES WITH BEVELED EDGES UNDERNEATH ELECTRICAL LEADS

BACKGROUND

A fluidic die is a component of a fluidic system. The fluidic die includes components that manipulate fluid flowing through the system. For example, a fluidic ejection die, which is an example of a fluidic die, includes a number of nozzles that eject fluid onto a surface. The fluidic die can also refer non-ejecting die that include non-ejecting actuators such as micro-recirculation pumps that move fluid through the fluidic die. Through these nozzles and pumps, fluid, such as ink and fusing agent among others, is ejected or moved. To eject the fluid, a fluidic ejection die includes a number of components. Specifically, the fluid to be ejected is held in an ejection chamber. A fluid actuator operates to dispel the fluid in the ejection chamber through an opening. As the fluid is expelled, a negative pressure within the ejection chamber draws additional fluid into the ejection chamber, and the process repeats.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
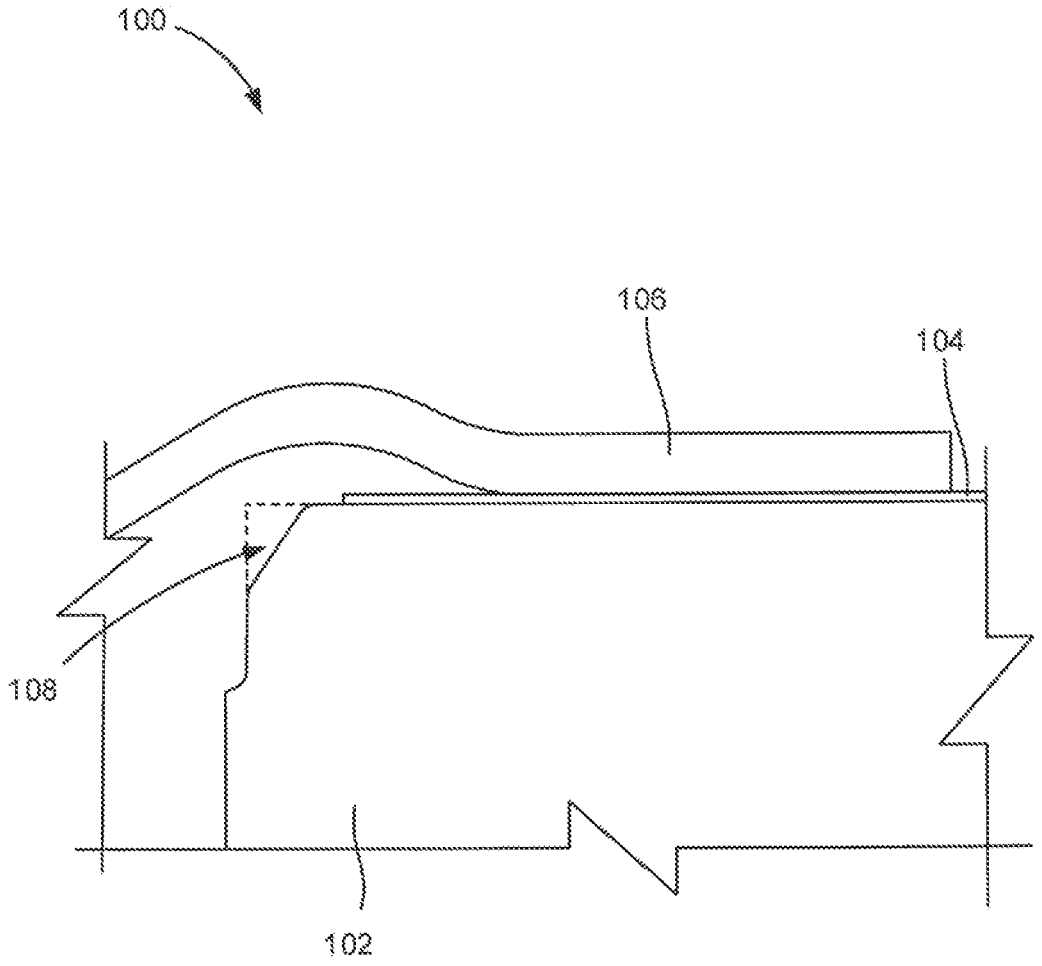
FIG. 1 is a cross-sectional view of a fluidic die with a beveled edge underneath an electrical lead, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluidic dies, as used herein, may describe a variety of types of integrated devices with which small volumes of fluid may be pumped, mixed, analyzed, ejected, etc. Such fluidic dies may include ejection dies, such as those found in printers, additive manufacturing distributor components, digital titration components, and/or other such devices with which volumes of fluid may be selectively and controllably ejected.

In a specific example, these fluidic systems are found in any number of printing devices such as inkjet printers, multi-function printers (MFPs), and additive manufacturing apparatuses. The fluidic systems in these devices are used for precisely, and rapidly, dispensing small quantities of fluid.

In one specific example, fluidic ejection systems dispense ink on a two-dimensional print medium such as paper. For example, during inkjet printing, fluid is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

In such fluidic ejection systems, fluid actuators are disposed in nozzles, where the nozzle includes an ejection chamber and an opening in addition to the fluid actuator. The fluid actuator in this case may be referred to as an ejector that, upon actuation, causes ejection of a fluid drop via the nozzle opening.

Fluid actuators may also be pumps. For example, some fluidic dies include microfluidic channels. A microfluidic channel is a channel of sufficiently small size (e.g., of nanometer sized scale, micrometer sized scale, millimeter sized scale, etc.) to facilitate conveyance of small volumes of fluid (e.g., picoliter scale, nanoliter scale, microliter scale, milliliter scale, etc.). Fluidic actuators may be disposed within these channels which, upon activation, may generate fluid displacement in the microfluidic channel.

Examples of fluid actuators include a piezoelectric membrane based actuator, a thermal resistor based actuator, an electrostatic membrane actuator, a mechanical/impact driven membrane actuator, a magneto-stictive drive actuator, or other such elements that may cause displacement of fluid responsive to electrical actuation. A fluidic die may include a plurality of fluid actuators, which may be referred to as an array of fluid actuators.

While such fluidic systems and dies undoubtedly have advanced the field of precise fluid delivery, some conditions impact their effectiveness. For example, an electrical connection is established between a controller and the fluidic die. Via this connection, control signals such as firing signals are passed to the fluidic die and feedback data is provided from the fluidic die to the controller. To form such an electrical connection, electrical leads, which are electrically coupled to the controller, are adhered to bond pads on the fluidic die. Some fluidic dies bend a die-bonded uninsulated flexible circuit lead over the die edge to connect with the controller. In some cases, the die bond pads and exposed leads are encapsulated to protect the circuitry from the fluid delivered by the system. If the distance between the die edge, which is grounded, and the flex lead, which is charged, is less than a minimum specified distance, an electrical failure may result when the encapsulant breaks down. Such an electrical short can lead to die performance degradation, and in some cases die inoperability.

Accordingly, the present specification describes a fluidic die that alleviates this and other conditions. Specifically, using photomasks in a bond pad region, die edges may be formed more precisely and a beveled die edge can be created. This beveled edge increases the space between the electrical leads and die edges to improve product reliability by increasing the minimum space between the powered electrical leads and the grounded die edge.

Specifically, the present specification describes a fluidic die. The fluidic die includes a surface on which a number of nozzles are formed. The fluidic die also includes an electrical interface to establish an electrical connection between the fluidic die and a fluidic die controller. The electrical interface includes 1) a bond pad disposed within a bond pad region of the surface and 2) an electrical lead coupled to the bond pad to establish an electrical connection between a fluidic die and a fluidic die controller. The fluidic die also includes a beveled edge along the surface underneath the electrical lead.

The present specification also describes a method for forming such a fluidic die. According to the method, a number of layers of material are formed to form a gap and expose a silicon base layer. A number of nozzles are formed in the base layer. A liquid etchant is then applied in the gap to wet etch the silicon base layer to form an angled trough. The bottom of the angled trough is cut to form at least one fluidic die with a beveled edge.

The present specification also describes another example of a fluidic die. In this example, the fluidic die includes a surface in which a number of nozzles are formed. Each nozzle includes an ejection chamber, an opening, and a fluid actuator disposed within the ejection chamber. The fluidic die also includes an electrical interface to establish an electrical connection between the fluidic die and a fluidic die controller. The electrical interface includes 1) a number of bond pads disposed within a bond pad region of the surface and 2) a number of electrical leads. An end of each electrical lead is to be coupled to a corresponding bond pad. The fluidic die also includes a protrusion which is parallel to an edge of the fluidic die. The protrusion extends from the surface under the number of electrical leads. The fluidic die also includes an encapsulant disposed over the electrical interface. The fluidic die also includes a beveled edge an along an edge of the surface underneath the number of electrical leads.

In summary, using such a fluidic die 1) prevents electrical shorts resulting from contact between a die edge and the electrical leads during manufacturing; 2) improves manufacturing yields; 3) reduces product reliability failures resulting from electrical conductors too close to the grounded die edge; 4) reduces the use of electrical tests to detect shorting, which testing may be destructive, slow, and time-intensive; and 5) reduces beam crash yield loss. However, the devices disclosed herein may address other matters and deficiencies in a number of technical areas.

As used in the present specification and in the appended claims, the term "actuator" refers an ejecting actuator or another non-ejecting actuator. For example, an ejector, which is an actuator, operates to eject fluid from the fluid ejection die. A recirculation pump, which is an example of a non-ejecting actuator, moves fluid through the fluid slots, channels, and pathways within the fluid die.

Accordingly, as used in the present specification and in the appended claims, the term "nozzle" refers to an individual component of a fluid ejection die that dispenses fluid onto a surface. The nozzle includes at least an ejection chamber, an ejector actuator, and an opening.

Further, as used in the present specification and in the appended claims, the term "fluidic die" refers to a component of a fluid system that includes a number of fluid actuators. A fluidic die includes fluidic ejection dies and non-ejecting fluidic dies.

Still further, as used in the present specification and in the appended claims, the term "surface" refers to multiple layers of a fluidic die including a silicon substrate, metallic films, and fluidic films.

As used in the present specification and in the appended claims, the term "a number of" or similar language is meant to be understood broadly as any positive number including 1 to infinity.

Turning now to the figures, FIG. 1 is a cross-sectional view of a fluidic die (100) with a beveled edge (108) underneath an electrical lead (106), according to an example of the principles described herein. As described above, the fluidic die (100) is part of a fluidic system that houses components for ejecting fluid and/or transporting fluid along various pathways. The fluid that is ejected and moved throughout the fluidic die (100) can be of various types including ink, biochemical agents, and/or fusing agents. The fluid is moved and/or ejected via an array of fluid actuators. Any number of fluid actuators may be formed on the fluidic die (100).

The fluidic die (100) includes a surface (102). The surface (102) refers to a surface in which various components of the fluidic die (100) are formed. The surface (102) may include multiple layers including a silicon substrate, oxide layers, and metallic layers, among others. An array of fluid chambers such as ejecting nozzles and microfluidic channels may be formed on the surface (102).

To eject/move the fluid, a fluidic die controller passes control signals and routes them to fluidic dies (100) of the fluid system. Accordingly, the fluidic die (100) includes an electrical interface to establish an electrical connection between the fluidic die (100) and the fluidic die controller such that these control signals may pass. The electrical interface includes a bond pad (104) disposed within a bond pad region of the surface (102). To facilitate easy coupling to an off-die component, the bond pad region may be near a perimeter of the fluidic die. The bond pad may be a surface adhered to, or formed within, the surface (102). The bond pad may be formed of gold, or other conductive material.

The electrical interface also includes an electrical lead (106) coupled to the bond pad (104). The electrical lead (106) may be a flexible copper wire that is adhered, for example via welding, to the bond pad (104). The juncture of these two conductive materials forms a bridge from where control signals from the fluidic controller, via the electrical lead(s) (106), can be passed to the fluidic die (100) via the bond pad (104). In some examples, as depicted in FIG. 1, the electrical lead (106) may be an angled lead indicating it changes direction. That is, one portion of the electrical lead (106) is parallel to the surface (102) and another portion is not. In another example, the electrical lead (106) may be straight. That is, the entirety of the electrical lead (106) may be parallel to the surface (102).

To prevent electrical shorting, the surface (102) includes a beveled edge (108) underneath the electrical lead (106). Because the surface (102) is grounded and the electrical lead (106) is charged, if these two components contact, or are within a predetermined distance of one another, a short may result. Such a short can lead to failure of the electrical interface and in some cases to failure of the fluidic die (100) entirely. Accordingly, a beveled edge (108) underneath the electrical lead (106) increases the distance between these two components. As is clearly depicted in FIG. 1, without such a bevel (as indicated in ghost in FIG. 1), the surface (102) would be disposed closer to the electrical lead (106).

Such a close distance can lead to fluidic die (100) failure. For example, during manufacturing, various operations can cause the electrical lead (106) to deflect towards the corner of the surface (102). In one example, mechanical force is used to press the electrical lead (106) onto the bond pad (104). Such force may cause a portion of the electrical lead (106) near the corner of the surface (102) to deflect towards the corner of the surface (102). This deflection may be permanent such that the electrical lead (106) is bent to be closer to the surface (102) than indicated in FIG. 1.

In another example, an encapsulant is dispensed over the electrical interface to protect and insulate this junction. Needles may be used to dispense this encapsulant. A user operating the needle may inadvertently contact the electrical lead (106) bending it to contact with the surface (102) or to deflect close enough to the surface (102) that an electrical short could arise when control signals are subsequently passed therethrough. In yet another example, even if a user does not contact an encapsulant needle to the electrical lead (106), the weight of the encapsulant may be enough to deflect the thin and fragile electrical lead (106).

Accordingly, the beveled edge (108) increases the distance between the electrical lead (106) and the surface (102) such that even in the presence of deflection and/or deformation of the electrical lead (106), the electrical lead (106) does not contact the surface (102). Nor does the electrical lead (106) come near enough to the surface (102) to cause an electrical short.

The beveled edge (108) may be formed using a wet-etch operation. That is, a photomask may be deposited on top of the surface (102) prior to the attachment of a bond pad (104). A liquid etchant is then applied which etches away at the portion of the surface (102) not covered by the photomask. Such an operation may form the beveled edge (108), which may be for example, beveled at a 54.7 degree angle with a top of the surface (102). The depth of the bevel of the beveled edge (108) may be controlled by an amount of time that an etchant is allowed to operate. Accordingly, the etchant may be allowed to operate such that the bevel is at least 25 microns deep.

The beveled edge (108) as described herein increases a distance between an electrical lead (106), which is charged, and a surface (102) of a fluidic die (100), which is grounded. This increased distance reduces the likelihood that the electrical lead (106) contacts, or comes within a threshold distance of, the surface (102). As such, the beveled edge (108) reduces the likelihood of electrical shorts. As electrical shorts can have an impact on control signal transmission as well as encapsulant reliability, such a beveled edge (108) increases the useful life of an associated fluidic die (100).

Figure 2:
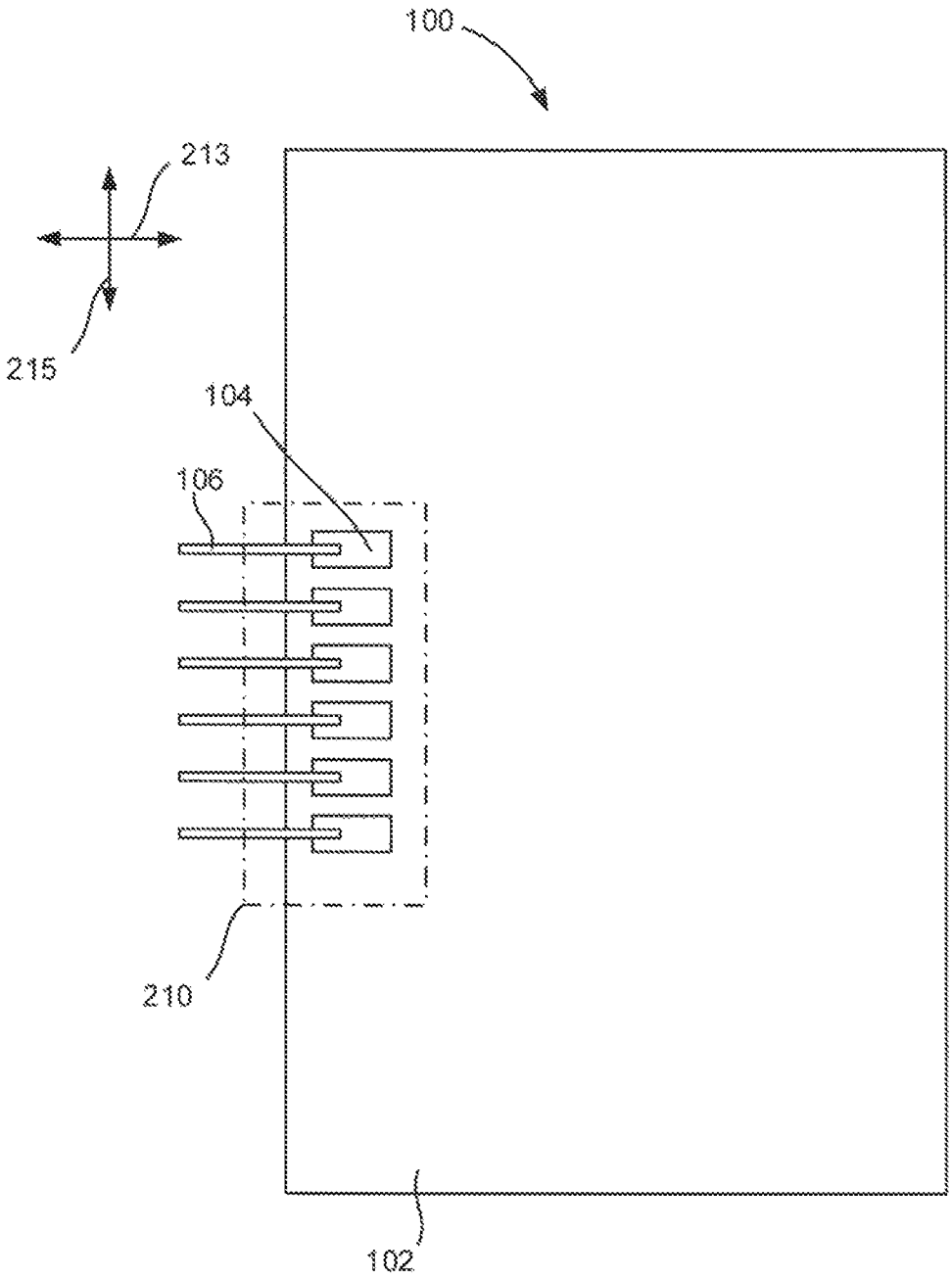
FIG. 2 is a top view of a fluidic die with a beveled edge underneath an electrical lead, according to an example of the principles described herein.

FIG. 2 is a top view of a fluidic die (100) with a beveled edge (FIG. 1, 108) underneath an electrical lead (FIG. 1, 106), according to an example of the principles described herein. FIG. 2 clearly depicts the disposition of the electrical interface at a perimeter of the fluidic die (100). Specifically that the bond pads (104) are disposed at the perimeter of the surface (102). Note that while FIG. 1 depicted a single bond pad (104) and a single electrical lead (106), a fluidic die (100) may include multiple bond pads (104) and multiple electrical leads (106). For simplicity, just one instance of a bond pad (104) and one instance of an electrical lead (106) is depicted with a reference number.

FIG. 2 also clearly indicates the bond pad region (210). In FIG. 2, the bond pad region (210) is indicated with a dashed-dot line. The bond pad region (210) is defined as a region of the surface (102) that includes the bond pads (104). For example, the bond pad region (210) may be defined by the outside edges of the boundary bond pads (210) and by a distance from an inside edge of the bond pads (104) to the perimeter of the surface (102).

In some examples, the beveled edge (FIG. 1, 108) may be disposed just in the bond pad region (210). That is, the photomask used to define the beveled edge (FIG. 1, 108) may be patterned such that an etching process forms a beveled edge (FIG. 1, 108) just in the bond pad region (210). In this example, other regions, i.e., non-bond pad regions may have a saw cut edge. That is, these edges may have a 90-degree corner. Put another way, in one example just a portion of the surface (102) edge underneath the number of electrical leads (106) is beveled.

Still further, the beveled edge (FIG. 1, 108) may be perpendicular to the electrical leads (106). That is, the electrical leads have a longitudinal axis in the direction indicated by the arrow (213) and the beveled edge (FIG. 1, 108) may run in a direction indicated by the arrow (215).

Figure 3:
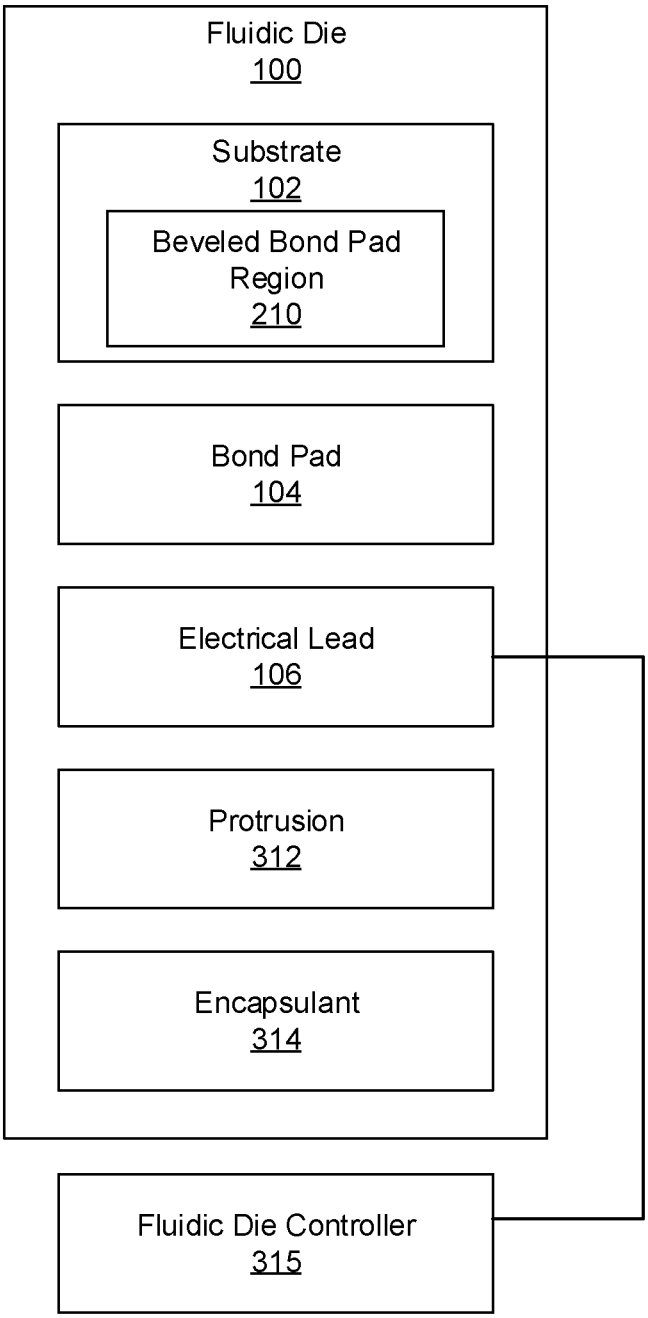
FIG. 3 is a block diagram of a fluidic die with a beveled edge underneath an electrical lead, according to an example of the principles described herein.

FIG. 3 is a block diagram of a fluidic die (100) with a beveled edge (FIG. 1, 108) underneath an electrical lead (106), according to an example of the principles described herein. As described above, the fluidic die (100) includes a surface (102) that has a beveled bond pad region (210). That is, the surface (102) has a bond pad region (210) wherein the electrical interface is formed, which bond pad region (210) includes a portion of an edge of the surface (102) that is beveled.

The fluidic die (100) also includes at least one bond pad (104) with an electrical lead (106) coupled thereto to form an electrical interface through which control signals and other information is passed from the fluidic die controller (315) to the fluidic die (100) and also from the fluidic die (100) to the fluidic die controller (315).

To further prevent electrical shorts, in some examples the fluidic die (100) includes a protrusion (312) that is disposed between the bond pad (104) and the beveled edge (FIG. 1, 108). The protrusion (312) extends upward from the surface (102). The protrusion (312) provides a surface that will contact the electrical lead (106) instead of the surface (102). That is, in the face of mechanical forces that cause the electrical lead (106) to deflect towards the surface (102), the electrical lead (106) will contact the protrusion (106) instead of the surface (102), and in some cases, contact the protrusion (106) prior to coming within a distance of the surface (102) that could result in electrical short.

In some examples, the fluidic die (100) also includes an encapsulant (314) that protects the electrical interface. That is, the encapsulant (314) may be a liquid material dispensed over the junction between the electrical leads (106) and bond pads (104). This material hardens when cured and electrically insulates the electrical interface. The encapsulant (314) may also be liquid impenetrable so that any fluid moved/ejected within the fluidic die (100) does not contact, and affect, the electrical interface.

Figure 4:
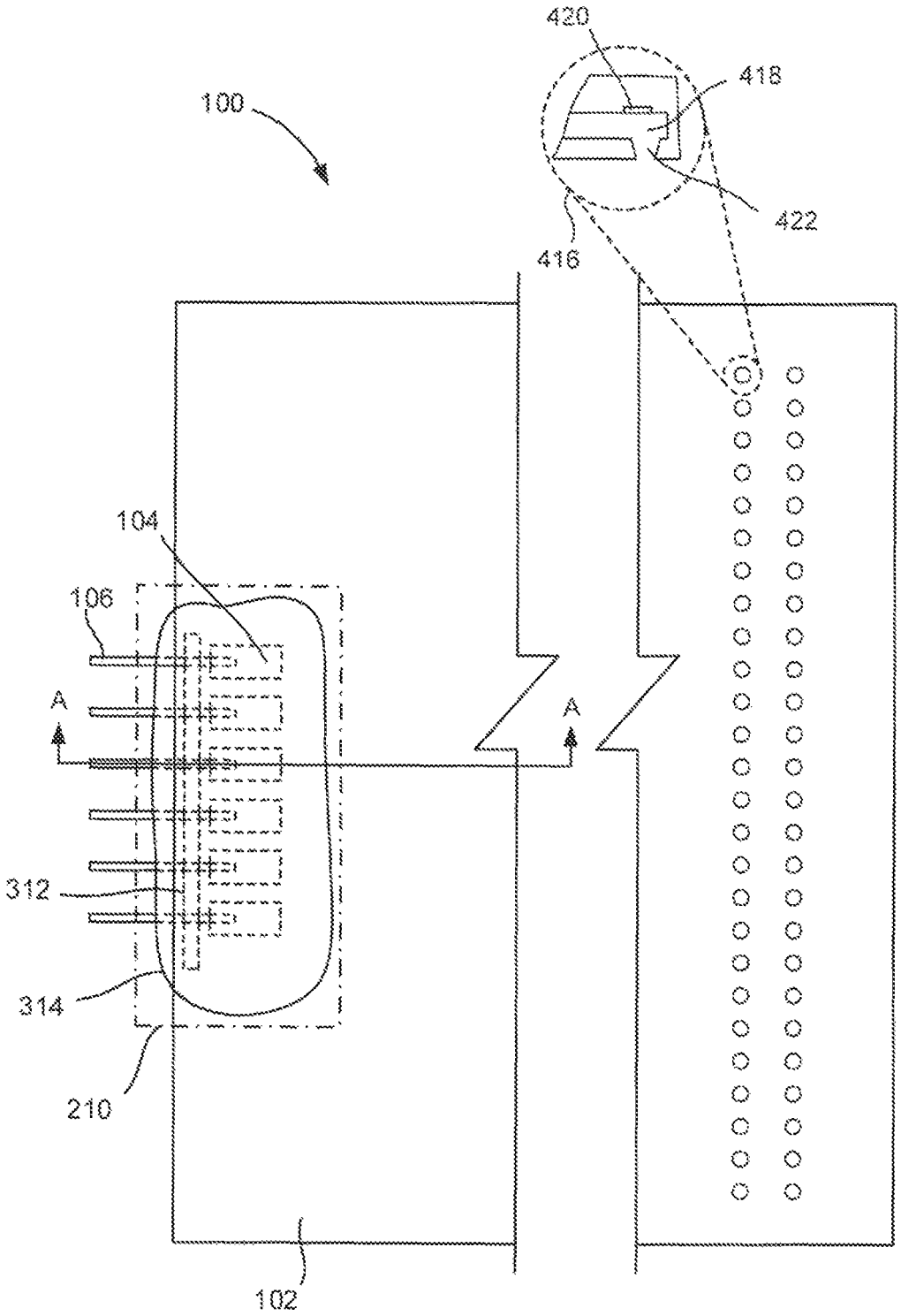
FIG. 4 is a top view of a fluidic die with a beveled edge underneath an electrical lead, according to an example of the principles described herein.

FIG. 4 is a top view of a fluidic die (100) with a beveled edge (FIG. 1, 108) underneath an electrical lead (106), according to an example of the principles described herein. As described above, the fluidic die (100) is a component of a fluidic system that moves/ejects fluid. In one such example, the fluidic die (100) is an ejection die that ejects fluid onto a surface. To eject the fluid, the ejection die includes a number of nozzles (416). For simplicity, in FIG. 4, one instance of a nozzle (416) is indicated with a reference number. A nozzle (416) includes an ejection chamber (418) to hold an amount of fluid to be ejected. Within each ejection chamber (418) is disposed a fluid actuator (420) which works to eject fluid from, or move fluid throughout, the fluidic die (100).

These fluid actuators (420) may be of varying types. For example, the fluid actuator (420) may include a firing resistor or other thermal device, a piezoelectric element, or other mechanism for ejecting or moving fluid from the fluidic die (100). For example, an ejector may be a firing resistor. The firing resistor heats up in response to an applied voltage. As the firing resistor heats up, a portion of the fluid in an ejection chamber vaporizes to generate a bubble. This bubble pushes fluid out an opening of the fluid chamber and onto a print medium. As the vaporized fluid bubble collapses, fluid is drawn into the ejection chamber from a passage that connects the fluid chamber (418) to a fluid feed slot in the fluidic die (100), and the process repeats. In this example, the fluidic die (100) may be a thermal inkjet (TIJ) fluidic die (100).

In another example, the fluid actuator (420) may be a piezoelectric device. As a voltage is applied, the piezoelectric device changes shape which generates a pressure pulse in the fluid chamber (418) that pushes the fluid through the chamber. In this example, the fluidic die (100) may be a piezoelectric inkjet (PIJ) fluidic die (100).

While specific reference is made to ejection chambers (418), the fluidic die (100) may include other types of fluid chambers. For example, the fluid chamber may be a channel through which fluid flows. That is, the fluidic die (100) may include an array of microfluidic channels. Each microfluidic channel includes a fluid actuator (420) that is a fluid pump. In this example, the fluid pump, when activated, displaces fluid within the microfluidic channel.

FIG. 4 also depicts the electrical interface, i.e., the bond pads (104) and the electrical leads (106). As described above, in some examples, the fluidic die (100) includes a protrusion (312) that is disposed underneath the electrical leads (106) to further prevent the electrical leads (106) from deflecting into the surface (102) or from coming within a predetermined distance of the surface (102). As is clearly depicted in FIG. 4, in some examples the protrusion (312) is just in the bond pad region (210) of the surface (102).

FIG. 4 also clearly depicts the encapsulant (314) dispensed over the electrical interface. In FIG. 4, those components disposed underneath the encapsulant (314) are indicated in dashed lines. That is the bond pads (104), the protrusion (312), and part of the electrical leads (106) are disposed under, and protected by, the encapsulant (314).

Figure 5:
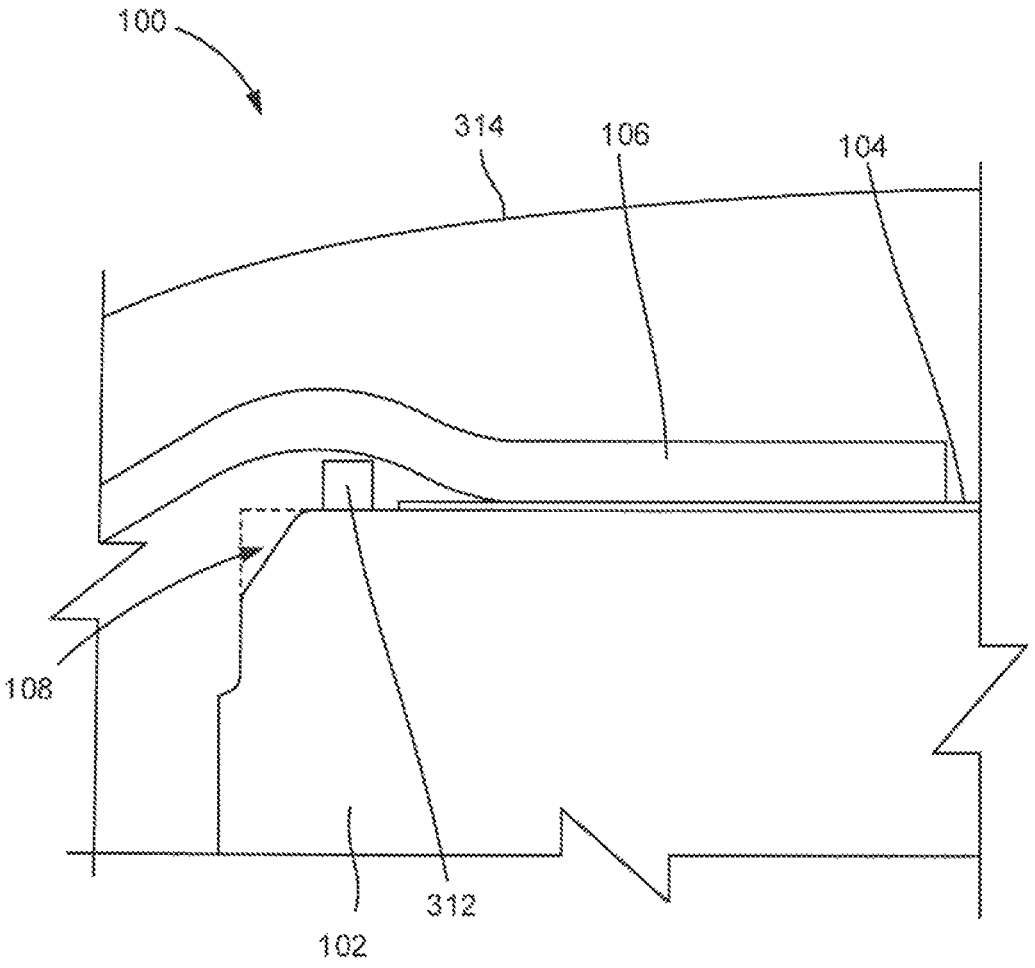
FIG. 5 is a cross-sectional view of a fluidic die with a beveled edge underneath an electrical lead, according to an example of the principles described herein.

FIG. 5 is a cross-sectional view of a fluidic die (100) with a beveled edge (108) underneath an electrical lead (106), according to an example of the principles described herein. Specifically, FIG. 5 is a portion of the cross-sectional view taken along the line A-A in FIG. 4 In addition to the surface (102), bond pad (104), electrical lead (106), and beveled edge (108), FIG. 5 also depicts the protrusion (312) that extends away from a surface of the fluidic die (100). In some examples, the protrusion (312) may be formed of an electrically non-conductive polymeric material. For example, as described above, the protrusion (312) provides a surface that comes into contact with the electrical lead (106) before the electrical lead (106) contacts the surface (102). Because the protrusion (312) is formed out of an electrically non-conductive material such as SU-8, contact between the protrusion (312) and the electrical lead (106) does not pose a risk of electrical short. Moreover, the polymeric material of the protrusion (312) is flexible such that it may deform to cushion the electrical lead (106) in the event of any deflection of the electrical lead (106). Such cushioning may prevent permanent deformation of the electrical lead (106). FIG. 5 also depicts that a portion of the electrical lead (106) that is over the protrusion (312) curves away from the protrusion.

Figure 6:
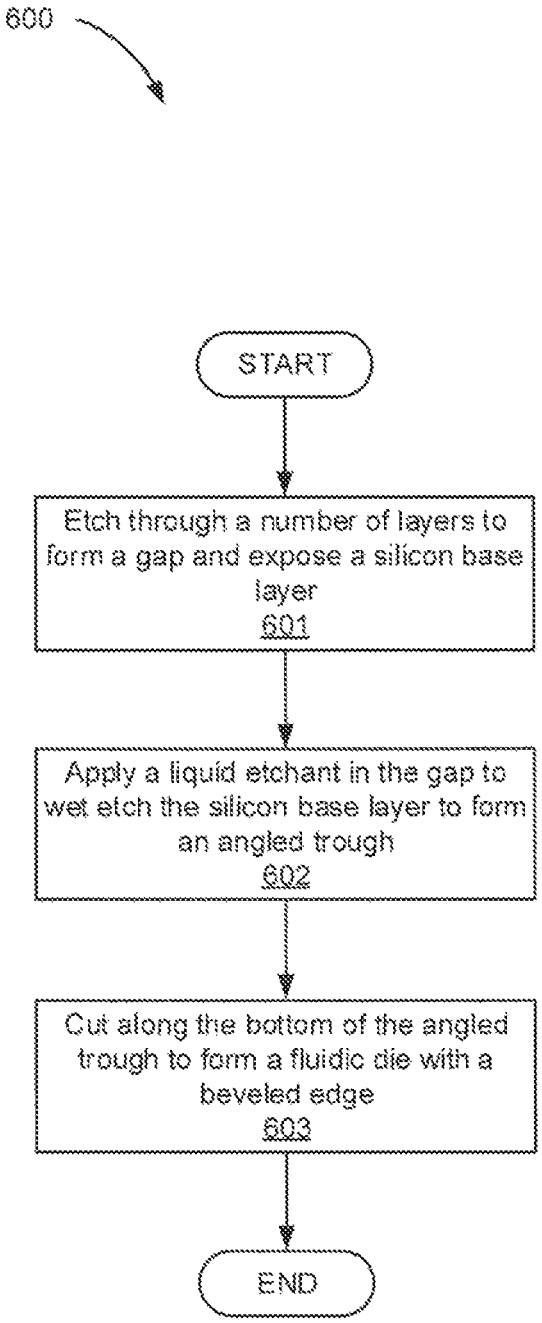
FIG. 6 is a flow chart of a method for forming a fluidic die with a beveled edge underneath an electrical lead, according to an example of the principles described herein.

FIG. 6 is a flow chart of a method (600) for forming a fluidic die (FIG. 1, 100) with a beveled edge (FIG. 1, 108) underneath an electrical lead (FIG. 1, 106), according to an example of the principles described herein. As described, a fluidic die (FIG. 1, 100) may include a surface (FIG. 1, 102) that is formed of a number of different layers, which include dielectric layers, metallic layers, and oxide layers, among others, each of which serve different purposes in carrying out the operations of a fluidic die (FIG. 1, 100). According to the method (600) portions of these layers are etched (block 601) to form a gap. Such an etching (block 601) also exposes a silicon base layer that is at the bottom of the number of layers. This silicon base layer may be a layer in which the nozzles (FIG. 4, 416) of a fluidic die (FIG. 1, 100) are formed.

With the gap formed, a liquid etchant is applied (block 602) into the gap to wet etch the silicon base layer. Examples of liquid etchants that may be used include tetramethylammonium hydroxide (TMAH) and potassium hydroxide (KOH). These compounds are anisotropic etchants that eat away at the silicon that is not covered by the layers on top of the silicon base layer. This etching process results in a trough in the silicon base layer that has a V-shape. Each wall may have an angle of 54.7 degrees relative to the surface. In some examples, the wet etching used to form the angled trough occurs at the same time as the formation of the fluid channels in the silicon base layer which are fluidly coupled to the nozzles (FIG. 4, 416). That is, fluid is delivered to nozzles (FIG. 4, 416) of a fluidic die (FIG. 1, 100) via fluid channels. These fluid channels are formed using a liquid etchant and accordingly can be formed at the same time as the angled trough that will ultimately become a beveled edge (FIG. 1, 108) of the fluidic die (FIG. 1, 100). As described above, the etching (block 601) through the number of layers and applying (block 602) of the etchant may be just in that region of the surface (FIG. 1, 102) wherein the bond pads (FIG. 1, 104) are formed.

The bottom of the angled trough is then cut (block 603) to form a fluidic die (FIG. 1, 100) with a beveled edge (FIG. 1, 108). That is, the layer of materials may be used for multiple fluidic dies (FIG. 1, 100), and etching (block 601) through a number of layers and applying (block 602) a liquid etchant may be done for a number of fluidic dies (FIG. 1, 100) in a single substrate. With such operations completed, each fluidic die (FIG. 1, 100) may be singulated by a saw, which saw when cutting through the angled trough, forms a beveled edge (FIG. 1, 108) on adjacent fluidic dies (FIG. 1, 100).

Figure 7A:
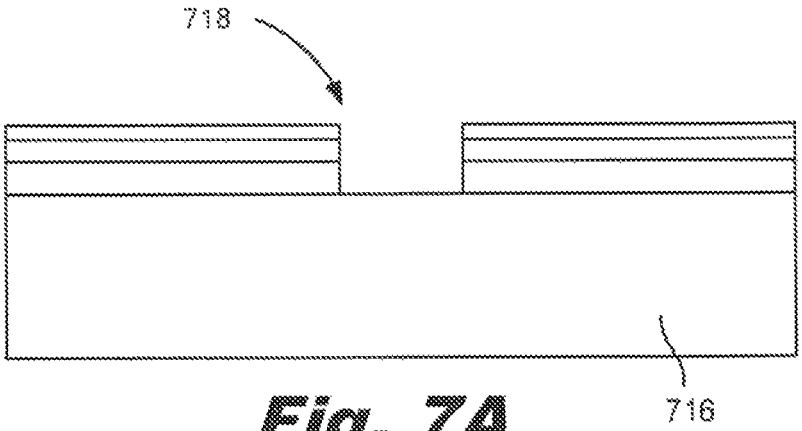
FIGS. 7A-7C illustrate the formation of a fluidic die with a beveled edge underneath an electrical lead, according to an example of the principles described herein.
Figure 7B:
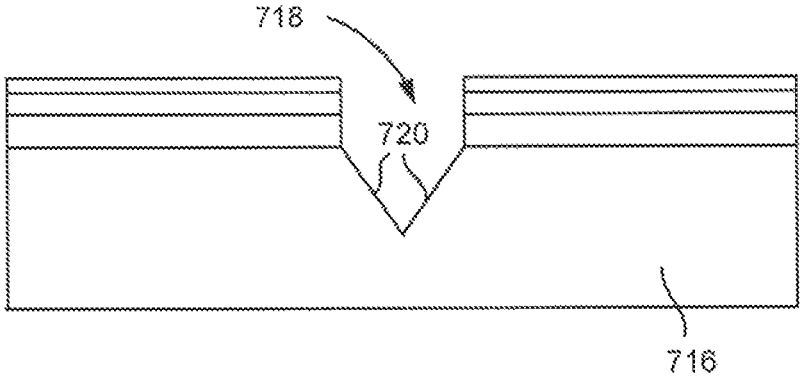
Figure 7C:
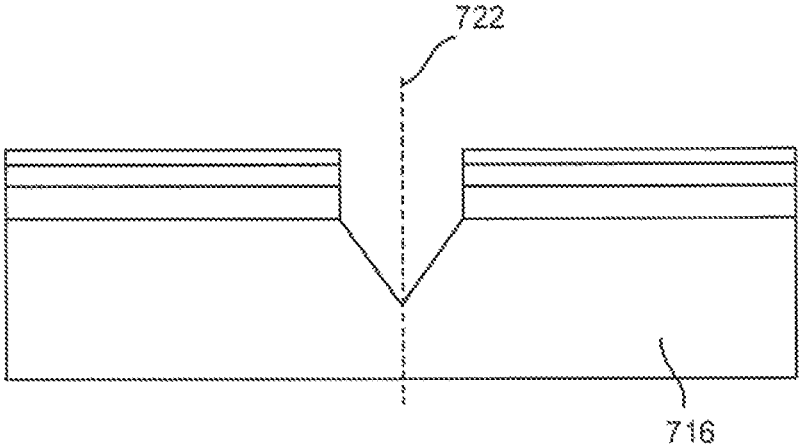

FIGS. 7A-7C illustrate the formation of a fluidic die (FIG. 1, 100) with a beveled edge (FIG. 1, 108) underneath an electrical lead (FIG. 1, 106), according to an example of the principles described herein. Specifically, FIG. 7A depicts the etching through of a number of layers of material to form a gap (718). As described above, the fluidic die (FIG. 1, 100) may be made up of a number of layers, one of which is a silicon base layer (716) in which nozzles (FIG. 4, 416) of the fluidic die (FIG. 1, 100) are formed. These other layers include any number of film, metallic, oxide, or other layers that carry out different purposes related to the operation of a fluidic die (FIG. 1, 100). Such an etching process exposes a portion of the silicon base layer (716). Note also, that in this example, the additional layers form a mask for a subsequent liquid etching operation.

Accordingly, during a wet etch operation as depicted in FIG. 7B, the silicon base layer (716) is etched away. In such a wet etch operation, the liquid etchant anisotropically etches the silicon base layer (716) to form a V-shaped trough with angled walls (720). The angle of these walls (720) is approximately 54.7 degrees. A cut (722) can then be made to singulate each fluidic die (FIG. 1, 100) as depicted in FIG. 7C. Following the cuts, the angled walls (720) then form the beveled edges (108) of the fluidic die.

In summary, using such a fluidic die 1) prevents electrical shorts resulting from contact between a die edge and the electrical leads during manufacturing; 2) improves manufacturing yields; 3) reduces product reliability failures resulting from electrical conductors too close to the grounded die edge; 4) reduces the use for electrical tests to detect shorting, which testing may be destructive, slow, and time-intensive; and 5) reduces beam crash yield loss. However, the devices disclosed herein may address other matters and deficiencies in a number of technical areas.

What is claimed is:

1. A fluidic die, comprising:

a surface on which a number of nozzles are formed; and an electrical interface to establish an electrical connection between the fluidic die and a fluidic die controller, the electrical interface comprising:

a bond pad disposed within a bond pad region of the surface; and an electrical lead coupled to the bond pad to establish an electrical connection between the fluidic die and the fluidic die controller; and a beveled edge along an edge of the surface underneath the electrical lead.

2. The fluidic die of claim 1, wherein the beveled edge forms a 54.7 degree angle with the surface of the fluidic die.

3. The fluidic die of claim 1, wherein the beveled edge extends just underneath the electrical lead.

4. The fluidic die of claim 1, wherein the bond pad region is near a perimeter of the fluidic die.

5. The fluidic die of claim 1, wherein the beveled edge is perpendicular to the electrical lead.

6. The fluidic die of claim 1, further comprising an encapsulant dispensed over the electrical interface.

7. The fluidic die of claim 1, further comprising a protrusion, parallel to an edge of the fluidic die, which protrusion extends from the surface under the electrical lead.

8. The fluidic die of claim 7, wherein the bevel is adjacent the protrusion.

9. The fluidic die of claim 7, wherein:

the protrusion is just in the bond pad region; and a portion of the electrical lead over the protrusion curves away from the protrusion.

10. The fluidic die of claim 7, wherein the beveled edge is on a same side of the electrical lead as the protrusion.

11. The fluidic die of claim 1, wherein the beveled edge is under a concave surface of the electrical lead.

12. The fluidic die of claim 1, wherein the beveled edge is on a same side of the electrical lead as the bond pad.

13. The fluidic die of claim 1, wherein the beveled edge is at least 25 microns deep.

14. A method, comprising:

etching through a number of layers of material to form a gap and expose a silicon base layer in which a number of nozzles are formed;

applying a liquid etchant in the gap to wet etch the silicon base layer to form an angled trough; and cutting along the bottom of the angled trough to form a fluidic die with a beveled edge.

15. The method of claim 14, wherein the wet etching of the silicon base layer occurs concurrently with forming fluid channels in the silicon base layer which lead to the nozzles.

16. A fluidic die, comprising:

a surface in which a number of nozzles are formed, wherein each nozzle comprises:

an ejection chamber;

an opening;

a fluid actuator disposed within the ejection chamber; and an electrical interface to establish an electrical connection between the fluidic die and a fluidic die controller, the electrical interface comprising:

a number of bond pads disposed within a bond pad region on a top surface of the surface; and a number of electrical leads, an end of each electrical lead to be coupled to a top surface of a corresponding bond pad;

a protrusion, parallel to an edge of the fluidic die, which protrusion extends from the surface under the number of electrical leads; and an encapsulant dispensed over the electrical interface; and a beveled edge along an edge of the surface underneath the number of electrical leads, which beveled edge increases a distance between the number of electrical leads and the surface.

17. The fluidic die of claim 16, wherein the number of electrical leads are angled leads.

18. The fluidic die of claim 16, wherein the number of electrical leads are straight leads.

19. The fluidic die of claim 16, wherein the protrusion is formed of an electrically non-conductive polymeric material.

20. The fluidic die of claim 16, wherein the beveled edge is just in the bond pad region.

* * * * *